US006756958B2

(12) United States Patent
Furuhashi et al.

(10) Patent No.: US 6,756,958 B2
(45) Date of Patent: Jun. 29, 2004

(54) LIQUID CRYSTAL DISPLAY DEVICE

(75) Inventors: Tsutomu Furuhashi, Yokohama (JP); Yoshihisa Ooishi, Yokohama (JP); Kazuyoshi Kawabe, Fujisawa (JP); Masaaki Kitajima, Mobara (JP); Masahiko Suzuki, Mobara (JP)

(73) Assignee: Hitachi, Ltd., Tokyo (JP)

( * ) Notice: Subject to any disclaimer, the term of this patent is extended or adjusted under 35 U.S.C. 154(b) by 189 days.

(21) Appl. No.: 09/931,213

(22) Filed: Aug. 17, 2001

(65) Prior Publication Data

US 2002/0063703 A1 May 30, 2002

(30) Foreign Application Priority Data

Nov. 30, 2000 (JP) ..... 2000-369608

(51) Int. Cl.[7] ..... G09G 3/36

(52) U.S. Cl. ..... 345/95; 345/94; 345/52; 345/212

(58) Field of Search ..... 345/52, 89, 92, 345/95, 211–213

(56) References Cited

U.S. PATENT DOCUMENTS 5,831,605 A * 11/1998 Yasui et al. ..... 345/211
6,310,616 B1 * 10/2001 Yanagi et al. ..... 345/211
2002/0093469 A1 * 7/2002 Suzuki et al. ..... 345/60
2002/0140648 A1 * 10/2002 Watanabe et al. ..... 345/87

* cited by examiner

*Primary Examiner*—Kent Chang
*Assistant Examiner*—Tom Sheng
(74) *Attorney, Agent, or Firm*—Antonelli, Terry, Stout & Kraus, LLP

(57) ABSTRACT

In a liquid crystal display device including a liquid crystal panel for displaying a tone in correspondence with a potential difference between a drain voltage and a common voltage, a drain driver circuit for generating the drain voltage corresponding to display data and applying the drain voltage to the liquid crystal panel, and a gate driver circuit for selecting a scanning line in the liquid crystal panel to which the drain voltage is applied, a power-supply circuit executes a comparative calculation of a reference common voltage and a feedback common voltage, then applying, to the liquid crystal panel, the common voltage obtained as a result of the comparative calculation, the reference common voltage whose potential level having been adjusted, the feedback common voltage is fedback from the liquid crystal panel.

21 Claims, 9 Drawing Sheets

LIQUID CRYSTAL DISPLAY DEVICE

BACKGROUND OF THE INVENTION

The present invention relates to a liquid crystal display device, and more particularly to a liquid crystal display device that drives a TFT (i.e., Thin Film Transistor) liquid crystal display panel by an alternation driving method.

As a conventional art that has taken into consideration the attainment voltage of a common voltage, JP-A-8-76083 has disclosed a liquid crystal display device where a positive or negative precharge voltage is added to a positive or negative driving voltage needed for the liquid crystal display. Also, JP-A-9-21995 has disclosed a liquid crystal display device where a differentiation signal generated with a predetermined time constant is superimposed on a common driving signal. Also, JP-A-10-253942 has disclosed the following liquid crystal display device: In a pixel where there has occurred a delay in the attainment voltage of the common voltage, a timing at which the TFT is switched off is set within a preparation time-period during which the output resistance of a source driving circuit has become a high resistance. This setting effectively decreases the load on a common voltage circuit at the time of immediately before the TFT is switched off, thereby intentionally causing an overshoot to occur in the common voltage at an instant when the output resistance of the source driving circuit has become the high resistance.

As a conventional art that has taken into consideration the alternation of a gate-off voltage, JP-A-2000-28992 has disclosed the following liquid crystal display device: The Low potential is varied in a state of being synchronized with a higher potential and a lower potential of the common potential Vcom, and, concerning a potential difference between the low potential and the common potential, the potential difference in the higher potential of the common potential is made larger than the potential difference in the lower potential of the common potential. Otherwise, the low potential is varied in synchronism with the higher and lower potentials of the common potential Vcom, and the potential difference in the higher potential of the common potential is made equal to the potential difference in the lower potential of the common potential.

In JP-A-8-76083, JP-A-9-21995, and JP-A-10-253942, no consideration has been given to the degradation in picture-quality referred to as "transverse smear". Namely, the final attainment voltage of the common voltage inside the liquid crystal panel is varied, depending on a load constant of the liquid crystal panel and a distortion in the common voltage due to the displayed contents. As a result, the voltage effective-value is varied for each display region (e.g., a region of an intermediate-luminance background alone, and background regions of the right and the left to a region where a rectangle on the white display is displayed). This gives rise to the picture-quality degradation referred to as the transverse smear such that the luminance differs for each display region.

In JP-A-2000-28992 either, no consideration has been given to the picture-quality degradation referred to as the transverse smear. Namely, in JP-A-2000-28992, the gate-off voltage is synchronized with the common voltage. As a result, the flowing in-and-out of current occurs in a cross capacitor and a parasitic capacitor, depending on the displayed contents. This slows the convergency of a liquid crystal panel's input unit onto the potential level of a drain voltage, thereby decreasing for each display region the voltage effective-value applied to the liquid crystal panel. This gives rise to the picture-quality degradation referred to as the transverse smear.

SUMMARY OF THE INVENTION

It is an object of the present invention to provide a liquid crystal display device allowing the transverse smear to be suppressed and the picture-quality to be enhanced.

In the present invention, the common voltage outputted from the liquid crystal panel is fedback to a power-supply circuit for generating the common voltage to be applied to the liquid crystal panel. This makes it possible to improve the convergency of the common voltage inside the liquid crystal panel, thereby allowing the transverse smear to be suppressed and the picture-quality to be enhanced.

In the present invention, the gate-off voltage for switching off a gate in a switching element within the liquid crystal panel is made high-impedance. This makes it possible to improve the convergency of the drain voltage inside the liquid crystal panel, thereby allowing the transverse smear to be suppressed and the picture-quality to be enhanced.

DESCRIPTION OF THE EMBODIMENTS

Referring to FIGS. 1 to 4, explanation will be given below concerning a 1st embodiment of the present invention. Incidentally, although the present invention is preferable for the common-inversion driving method, it is also applicable to the dot-inversion driving method. Additionally, explanation will be presented below with the employment of a normally-black liquid crystal. In the normally-black liquid crystal, the display characteristic of the liquid crystal display device in the following embodiments becomes black display when the voltage effective-value applied to the liquid crystal in the pixel unit is small, and becomes white display when the voltage effective-value is large.

Figure 1:
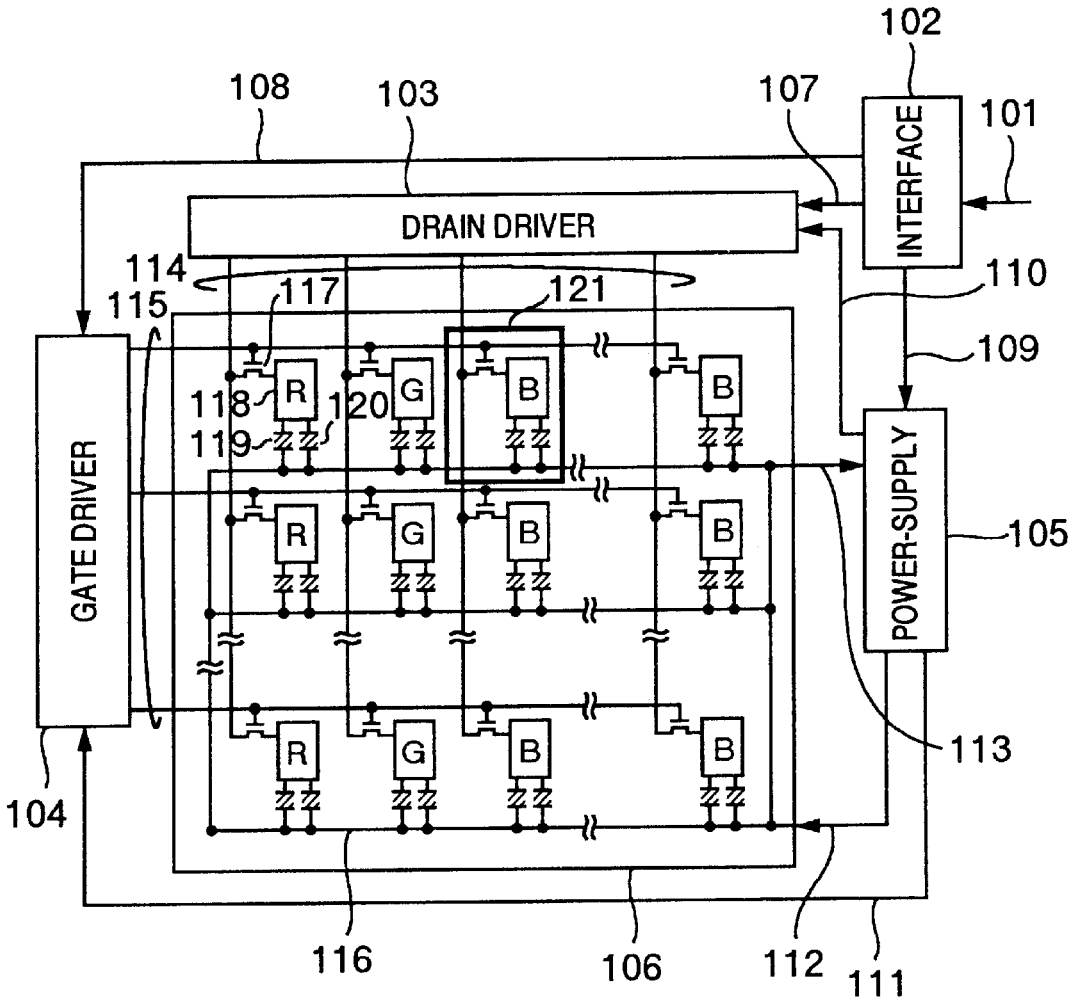
FIG. 1 is a block diagram for illustrating a liquid crystal display device in the present invention.
Figure 2:
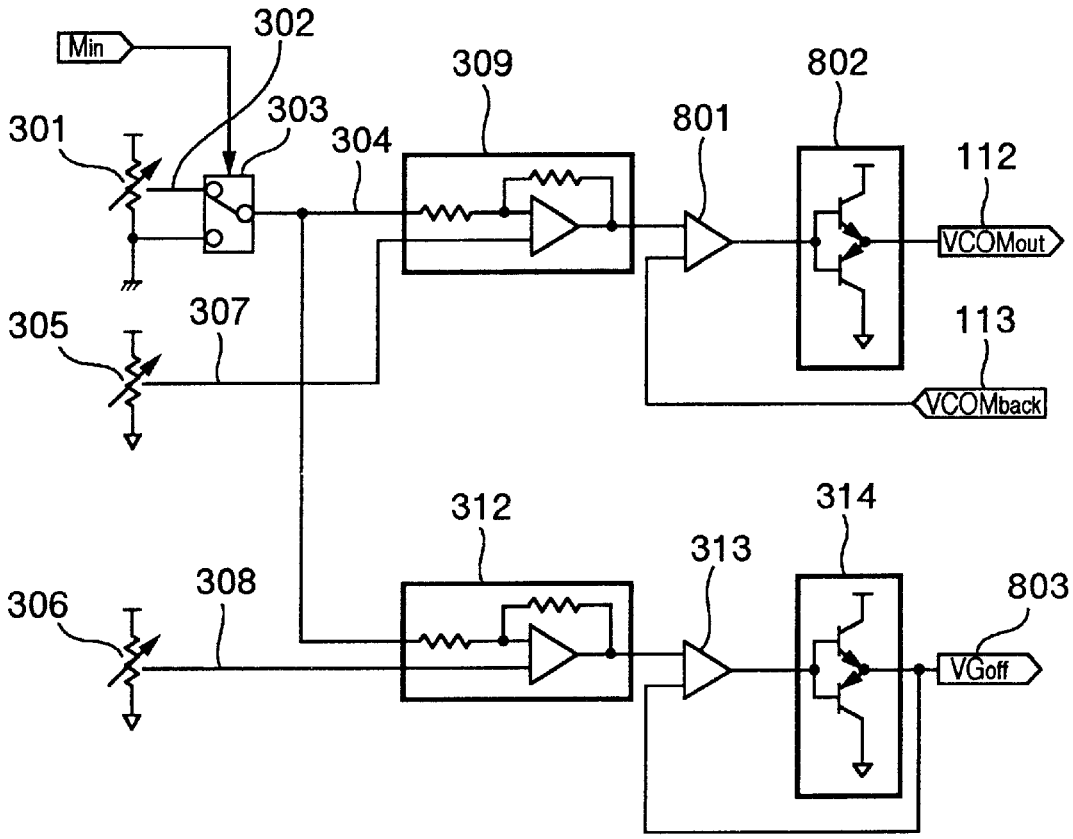
FIG. 2 is a diagram for illustrating, of the power-supply circuit in the present invention, a circuit for generating the common voltage and a circuit for generating the gate-off voltage.
Figure 3A:
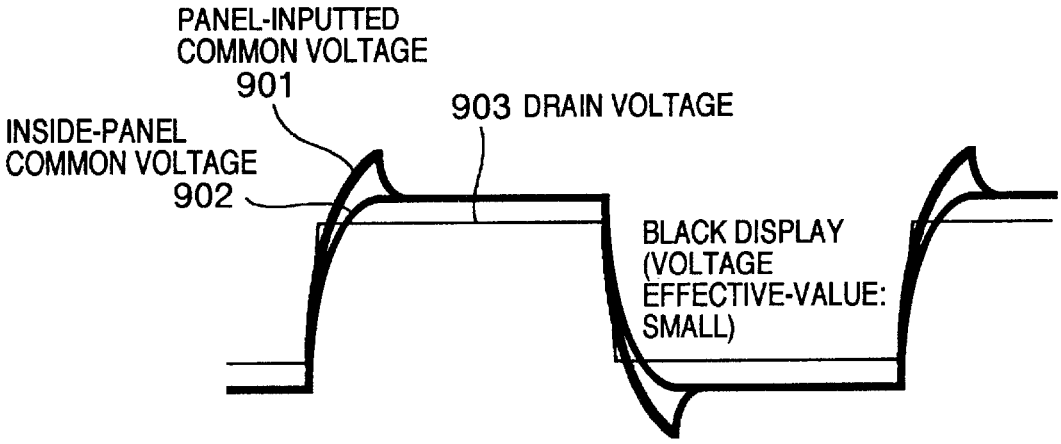
FIGS. 3A, 3B are diagrams for illustrating voltage waveforms of the common voltage and the gate-off voltage in the present invention.
Figure 3B:
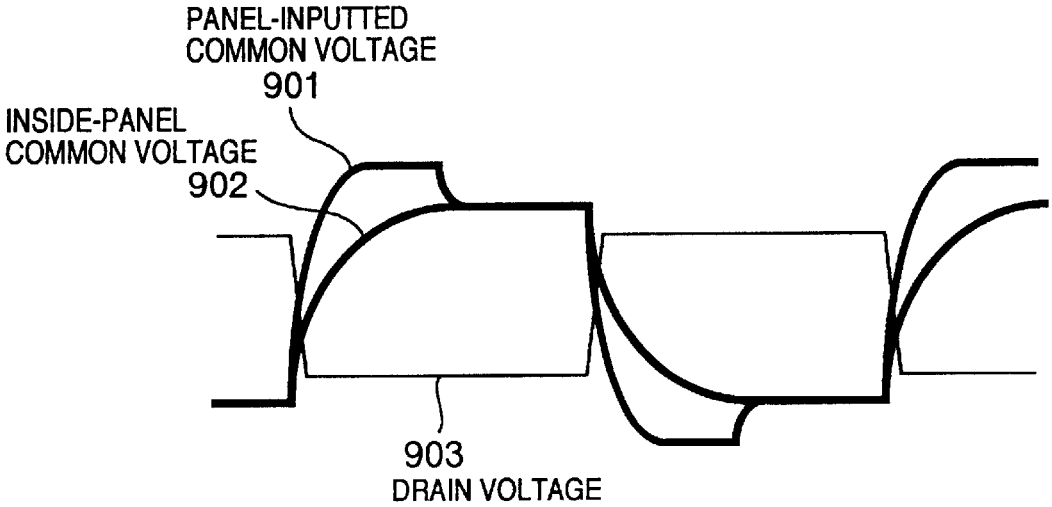
Figure 4:
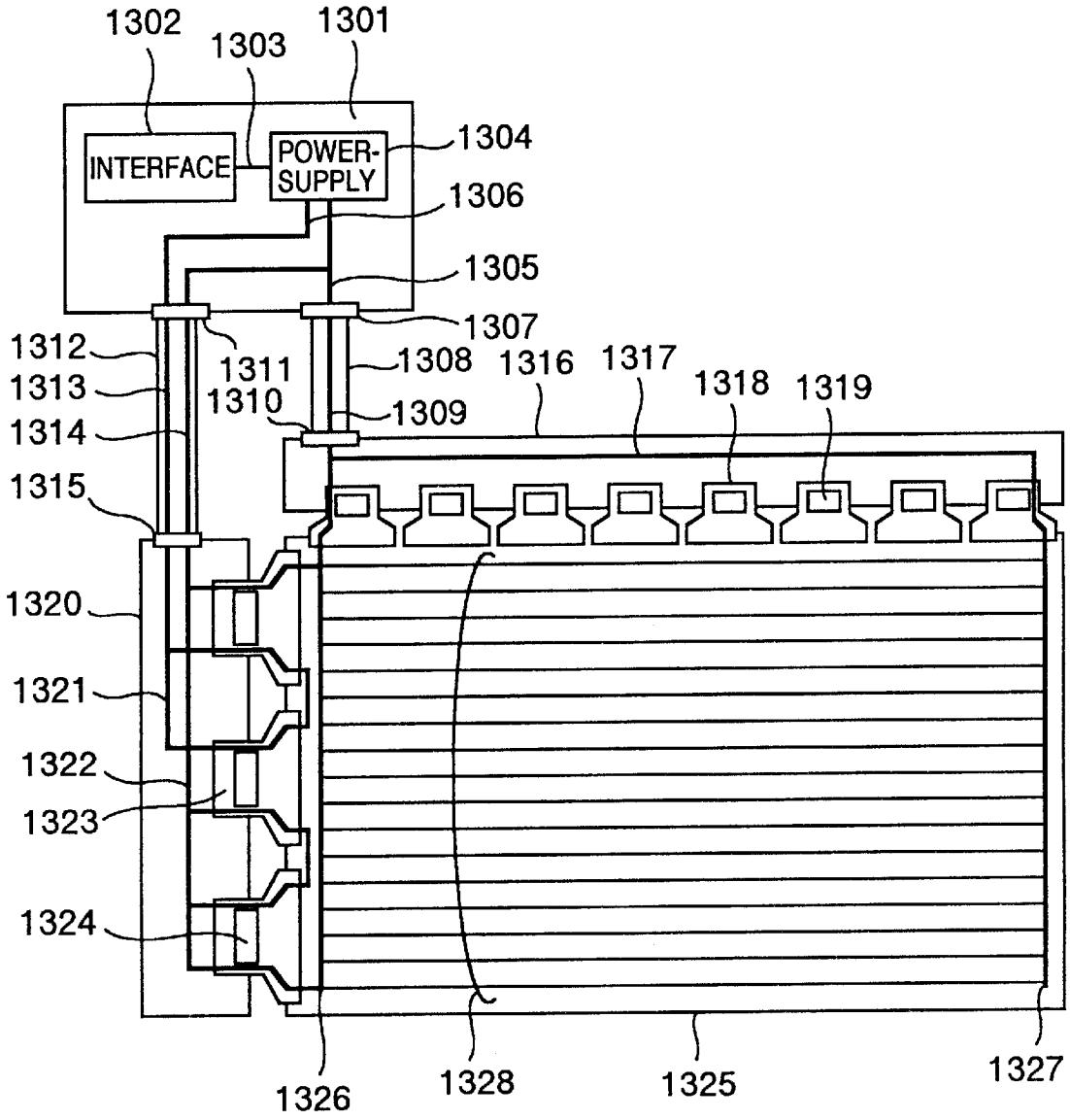
FIG. 4 is a diagram for explaining in further detail a portion in the present invention where the common voltage inside the liquid crystal panel is fedback.
Figure 5:
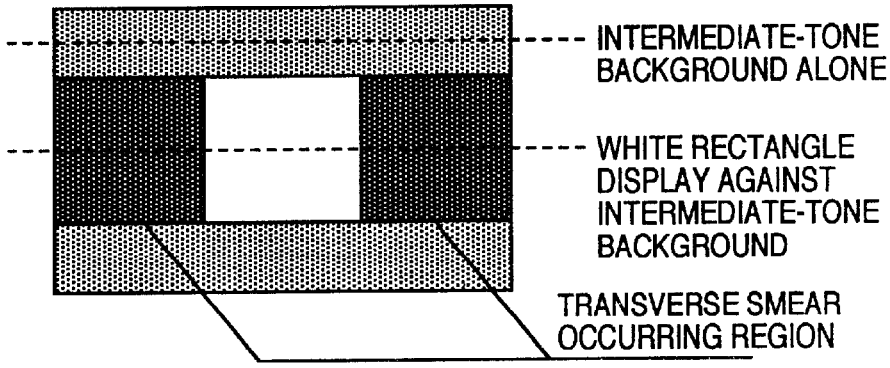
FIG. 5 is a diagram for explaining the picture-quality degradation referred to as the transverse smear.

FIG. 1 is a block diagram for illustrating a liquid crystal display device in the present invention. FIG. 2 is a diagram for illustrating, of the power-supply circuit in the present invention, a circuit for generating the common voltage and a circuit for generating the gate-off voltage. FIGS. 3A, 3B are diagrams for illustrating voltage waveforms of the common voltage and the gate-off voltage in the present invention. FIG. 4 is a diagram for explaining in further detail a portion in the present invention where the common voltage inside the liquid crystal panel is fedback. FIG. 5 is a diagram for explaining the picture-quality degradation referred to as the transverse smear.

In the block diagram of the liquid crystal display device in FIG. 1, reference numerals denote the following configuration components, respectively: 101 a data bus for transferring display data and a synchronization signal inputted from an external apparatus (not illustrated), 102 an interface circuit for controlling a driving circuit of the liquid crystal display device, 103 a drain driver circuit for generating a tone voltage (also referred to as "drain voltage") corresponding to the display data, 104 a gate driver circuit for selecting in sequence a line on which the display is performed, 105 a power-supply circuit for generating various types of power-supply voltages for driving the liquid crystal display device, 106 a liquid crystal panel including a plurality of pixel units, 107 a data bus for transferring the display data and the synchronization signal from the interface circuit 102 to the drain driver circuit 103, 108 a signal line bus for transferring the synchronization signal to the gate driver circuit 104, 109 a signal line for transferring an alternating signal to the power-supply circuit 105, 110 a power-supply bus for transmitting a reference tone voltage fed from the power-supply circuit 105 to the drain driver circuit 103, 111 a power-supply bus for transmitting the power-supply voltage for driving the gate driver circuit 104, 112 a common voltage line for transmitting a common voltage fed to the liquid crystal panel 106, 113 a common voltage line for feedbacking, to the power-supply circuit 105, the common voltage existing inside the liquid crystal panel 106, 114 a drain-line group for transferring the drain voltage that the drain driver circuit 103 outputs, 115 a gate-line group for transmitting a scanning voltage (also referred to as "gate voltage") that the gate driver circuit 104 outputs, 116 a common electrode inside the liquid crystal panel 106, 117 a TFT for performing the switching operation, 118 a plurality of pixel electrodes arranged in a matrix-like configuration, 119 liquid crystal, 120 a compensation capacitor, 121 a pixel unit.

Moreover, the common electrode 116 is common to all the pixel units existing inside the liquid crystal panel 106. In the case of the color display, the drain-line group 114 has the signal lines by the number of the horizontal resolutions×3 (i.e., red: R, green: G, and blue: B). The gate-line group 115 has the signal lines by the number of the vertical resolutions. The common electrode 116 transmits the common voltage generated by the power-supply circuit 105 into the inside of the liquid crystal panel 106 via a common voltage line 112. The liquid crystal panel has been formed into a color liquid crystal panel where color filters for R, G, and B are provided for each pixel. The liquid crystal 119 is expressed as an equivalent model of capacitance. The pixel unit 121 is positioned at a location where the drain-line group 114 and the gate-line group 115 intersect with each other, and the pixel unit includes the TFT 117, the pixel electrode 118, the liquid crystal 119, and the compensation capacitor 120.

In the present invention, the power-supply circuit 105 includes the circuit for generating the common voltage and the circuit for generating the gate-off voltage, which are illustrated in FIG. 2. In FIG. 2, the reference numerals denote the following components: 301 a variable resistor for adjusting the amplitude level of the common voltage, 302 a power-supply line for transmitting a reference common voltage of direct voltage generated by the variable resistor 301, 303 a voltage selector for selecting, in accordance with the alternating signal 109, the reference common voltage transmitted by the voltage line 302 and a voltage at the ground level, 304 the reference voltage of the alternated common voltage generated by the voltage selector 302, 305 a variable resistor for adjusting the potential level of the common voltage, 306 a variable resistor for adjusting the potential level of the gate-off voltage, 307, 308 voltage lines for transmitting the adjusted voltages generated by the variable resistors 305, 306 respectively, 309 an calculating circuit for inputting the reference common voltage and the adjusted voltages transmitted by the voltage lines 304, 307, and for adjusting the potential level of the common voltage, 801 an amplifying circuit (e.g., an operational amplifier), 802 current amplifying circuit (e.g., a transistor), 312 a calculating circuit for inputting the reference common voltage and the adjusted voltages transmitted by the voltage lines 304, 308, and for adjusting the potential level of the gate-off voltage, 313 an amplifying circuit, 314 current amplifying circuit, 803 a voltage line for transmitting the gate-off voltage generated by the current amplifying circuit 314. The gate-off voltage is a voltage for switching off the gate of the TFT that is the switching element. The application of the gate-off voltage stops the passing of the current through the TFT. A gate-on voltage is a voltage for switching on the gate of the TFT that is the switching element. The application of the gate-on voltage starts the passing of the current through the TFT.

As the feedback voltage of the amplifying circuit 801, the common voltage is used which is transmitted by the common voltage line 113 for feedbacking the common voltage existing inside the liquid crystal panel 106 (i.e., the feedback method). This feedback method may be combined with the boost circuit method where the common voltage that is an output from the current amplifying circuit 802 is used as the feedback voltage of the amplifying circuit 801. As the feedback voltage of the amplifying circuit 312, the gate-off voltage is used which is transmitted by the voltage line 803 that is an output from the current amplifying circuit 314 (i.e., the boost circuit method). Also, it is assumed that the voltage line 803 for transmitting the gate-off voltage is included in the voltage line 111 illustrated in FIG. 1.

In FIG. 3, FIG. 3A illustrates the voltage waveform at the time when black display (i.e., the voltage effective-value is small) is performed. Reference numerals therein denote the following components: 901 a panel-inputted common voltage transmitted by the common voltage line 112, 902 an inside-panel common voltage of the common electrode line 116 existing inside the liquid crystal panel 106, 903 the drain voltage generated by the drain driver circuit 103 and transferred by the drain-line group 114. FIG. 3B illustrates the voltage waveform at the time when white display (i.e., the voltage effective-value is large) is performed, and indicates the voltage waveform at the same locations as those in FIG. 3A.

Hereinafter, explanation will be given below regarding the detailed operation of the liquid crystal display device in the present invention.

The liquid crystal display device in the present invention inputs the display data and the synchronization signal from the external apparatus via the data bus 101. The interface circuit 102 provides the display data and a control signal to the drain driver circuit 103 via the data bus 107 and to the gate driver circuit 104 via the signal bus 108.

The drain driver circuit 103 generates the drain voltage corresponding to the display data inputted, then outputting the drain voltage to the drain-line group 114. In order to select a line to which the drain voltage outputted by the drain driver circuit 103 is applied, the gate driver circuit 104 applies the gate-on voltage becoming a selected voltage to a corresponding gate line of the gate-line group 115. In the pixel 121 on the line on which the gate-on voltage has been applied to the gate line, the corresponding TFT 117 is switched into the ON state. As a result, the drain voltage transferred via the drain-line group 114 is applied to the pixel electrode 118, the liquid crystal 119, and the compensation capacitor 120. Furthermore, when this voltage-applying operation is terminated, the gate-off voltage becoming a non-selected voltage is applied to the gate line. As a consequence, the TFT 117 is switched into the OFF state, thereby holding the drain voltage applied to the pixel electrode 118, the liquid crystal 119, and the compensation capacitor 120. Repeating this process all over the lines makes it possible to apply, to all the pixels, the tone voltage corresponding to the display data.

In the present embodiment, the following driving method is applied: The alternating voltage is applied to the liquid crystal, thereby preventing a degradation such as a burning. At the same time, a positive-polarity tone voltage and a negative-polarity tone voltage are applied alternately for each pixel, thereby preventing a flickering called "flicker". Namely, in accordance with the alternating signal 109, the common voltage is alternated on a 1-line basis. Then, if the common voltage is at a lower potential level, the drain voltage is set to be at a higher potential level than the common voltage, thereby applying a positive-polarity drain voltage to each pixel 121. Also, if the common voltage is at a higher potential level, the drain voltage is set to be at a lower potential level than the common voltage, thereby applying the negative-polarity tone voltage to each pixel 121. This allows the positive-polarity tone voltage and the negative-polarity tone voltage to be applied alternately for each pixel, thereby making it possible to prevent the flicker. Also, in the next frame, by applying a tone voltage the polarity of which differs from that of the tone voltage applied to each pixel 121 previously, it becomes possible to prevent the degradation such as the burning.

Incidentally, in the generation of the common voltage which characterizes the liquid crystal display device in the present invention, the common voltage to be inputted into the liquid crystal panel 106 is generated by feedbacking the common voltage existing inside the liquid crystal panel 106. The explanation will be given below regarding this operation, referring to FIGS. 2, 3.

In FIG. 2, the common voltage needs to be alternated with a constant amplitude and in correspondence with the alternating signal 109. Accordingly, the above-described alternated reference common voltage is generated by the variable resistor 301 and the voltage selector 302, then being transmitted by the power-supply line 304. The calculating circuit 309 inputs this reference common voltage and the adjusted voltage generated by the variable resistor 305, thereby adjusting the potential level of the common voltage. This makes it possible to equate a voltage effective-value of the positive-polarity drain voltage at the time of being applied to the liquid crystal 119 with that of a negative-polarity drain voltage at the time of being applied thereto.

Moreover, the common voltage whose driving capability has been enhanced by the amplifying circuit 801 and the current amplifying circuit 802 is transmitted to the liquid crystal panel 106 via the common voltage line 112. Here, the amplifying circuit 801 and the current amplifying circuit 802 have employed the amplifying circuit configuration where the common voltage existing inside the liquid crystal panel 106 is fedback via the common voltage line 113. Consequently, as the common voltage generated by the amplifying circuit 801 and the current amplifying circuit 802, there is outputted a voltage value which indicates a potential difference obtained as a result of comparing the common voltage generated by the calculating circuit 309 with the common voltage fedback via the common voltage line 113. In comparison with the common voltage generated by the amplifying circuit 801 and the current amplifying circuit 802, the common voltage fedback from the inside of the liquid crystal panel 106 turns out to have a dull voltage waveform with a certain time constant. This is caused by influences of a load capacitance, a resistance, or the like inside the liquid crystal panel 106. In view of this, the amplifying circuit 801 and the current amplifying circuit 802 operates so that the common voltage fedback from the inside of the liquid crystal panel 106 is caused to transition to the common voltage level generated by the calculating circuit 309.

As a consequence, as illustrated in FIG. 3, the panel-inputted common voltage 901, which is to be inputted into the liquid crystal panel 106, i.e., is to be outputted via the common voltage line 112, has the following voltage waveform: A voltage waveform that is overshot onto a positive-polarity side when, with the timing of the alternation, the common voltage transitions from the negative-polarity to the positive-polarity, and that is overshot onto a negative-polarity side when the common voltage transitions from the positive-polarity to the negative-polarity. The effect of this overshot panel-inputted common voltage 901 causes the inside-panel common voltage 902 to transition to a higher potential (or a lower potential). This, eventually, enhances the charging rate of the inside-panel common voltage 902. In addition, if the inside-panel common voltage 902 transitions to a desired common voltage level, the panel-inputted common voltage 901 also transitions to a desired common voltage level. Consequently, it turns out that the inside-panel common voltage 902 stabilizes at the same level as the common voltage level generated by the calculating circuit 309.

FIG. 3A illustrates the black display state, where the voltage effective-value applied to the liquid crystal is small and thus the panel-inputted common voltage 901 and the drain voltage 903 are alternated in one and the same phase. Accordingly, the inside-panel common voltage 902 is hardly subjected to the influences of the load by a capacitance or a resistance inside the liquid crystal panel 106, thus converging, at a high-rate, onto the potential level of the panel-inputted common voltage 901. Consequently, it has been found that there is not so much of the overshot quantity of the panel-inputted common voltage 901.

In contrast to this, FIG. 3B illustrates the white display state, where the voltage effective-value applied to the liquid crystal is large and thus the panel-inputted common voltage 901 and the drain voltage 903 are alternated in phases inverted to each other. Accordingly, the inside-panel common voltage 902 is subjected to the influences of the load by a capacitance or a resistance inside the liquid crystal panel 106. Furthermore, the convergency thereof is worsened from the influence of the fact that the drain voltage 903 is charged into the pixel electrode 118, the liquid crystal 119, and the additional capacitor 120.

A phenomenon that a variation in the display luminance caused by this decrease in the effective voltage becomes visibly conspicuous as the picture-quality degradation is of the case where, as illustrated in FIG. 5, a white rectangle is displayed against an intermediate-tone background. In the case of this display state, between regions (lines) of the intermediate-luminance background alone and a region (lines) where the rectangle on the white display is displayed, the amplitude value of the drain voltage in the drain-line group displaying the white rectangle becomes outstandingly different. Accordingly, the final attainment potential of the inside-panel common voltage is varied in the respective display regions. As a result, between the regions (lines) of the intermediate-luminance background alone and intermediate-luminance background regions existing on the right and the left to the region where the rectangle on the white display is displayed, the effective voltage of the inside-panel common voltage applied to the liquid crystal in the pixel units becomes different, in spite of the fact that the intermediate-tone drain voltage level outputted from the drain driver circuit is one and the same level therebetween in comparison with the lines of the intermediate-luminance background alone. Consequently, the display exhibiting the different luminances appears therebetween. This is the picture-quality degradation referred to as the transverse smear.

In the present embodiment, however, the panel-inputted common voltage 901 is generated by feedbacking the inside-panel common voltage 902 to the amplifying circuit 801 and the current amplifying circuit 802. This condition allows the overshoot state to be held until the inside-panel common voltage 902 attains to the common voltage level generated by the calculating circuit 309, thereby making it possible to improve the convergency of the inside-panel common voltage 902.

FIG. 4 illustrates an example of the implemented state of the liquid crystal display device in the present invention illustrated in FIG. 1. Referring to FIG. 4, the further detailed explanation will be given below concerning the portion in the present invention where the common voltage inside the liquid crystal panel is fedback.

In FIG. 4, the reference numerals denote the following components: 1301 an interface board, 1302 an interface circuit (corresponding to the one 102 illustrated in FIG. 1), 1303 an alternating signal (corresponding to the one 109 illustrated in FIG. 1), 1304 a power-supply circuit (corresponding to the one 105 illustrated in FIG. 1), 1305 a common voltage line (corresponding to the one 112 illustrated in FIG. 1), 1306 a common voltage line (corresponding to the one 113 illustrated in FIG. 1), 1307 a connector, 1308 a cable, 1309 an inner-common voltage line of a signal line transferred by the cable 1308, 1310 a connector, 1311 a connector, 1312 a cable, 1313 an inner-common voltage line of a signal line transferred by the cable 1312, 1314 a common voltage line connected to the common voltage line 1305, 1315 a connector, 1316 a drain board for implementing drain driver LSIs, 1317 a common voltage line on the drain board 1316, 1318 packages for implementing the drain driver LSIs, 1319 main bodies of the drain driver LSIs, 1320 a gate board for implementing gate driver LSIs, 1321 a common voltage line on the gate board 1320, 1323 packages for implementing the gate driver LSIs, 1324 main bodies of the gate driver LSIs, 1325 a liquid crystal panel, 1326 a common bus line on the liquid crystal panel 1325, 132 7 a common bus line on the liquid crystal panel 1325, 1328 common voltage lines wired on the liquid crystal panel on each line basis in the transverse direction.

Moreover, the common voltage line 1309 is connected to the common voltage line 1305 via the connector 1307. The common voltage line 1313 is connected to the common voltage line 1306 via the connector 1311. The common voltage line 1317 is connected to the common voltage line 1309 via the connector 1310. The common voltage line 1321 is connected to the common voltage line 1313 via the connector 1315. In the example illustrated in FIG. 4, since it has been assumed that the liquid crystal panel is a color liquid crystal panel with a 1024-dot horizontal resolution and the output terminals' number of the drain driver LSI is equal to 384, the number of the drain driver LSIs mounted is equal to 8 in total (i.e., 1024×3÷384). Also, in the example illustrated in FIG. 4, since it has been assumed that the vertical lines' number is equal to 768 and the output terminals' number of the gate driver LSI is equal to 256, the number of the gate driver LSIs mounted is equal to 3 in total (i.e., 768÷256).

In the example illustrated in FIG. 4, as a route along which the common voltage generated by the power-supply circuit 1304 on the interface board 1301 is fed to the liquid crystal panel, the common voltage is transferred to the drain board 1316 and the gate board 1320 by using the cable 1308 and the cable 1312, respectively. The common voltages transferred to the respective boards are transferred to the common bus lines 1327, 1326 on the liquid crystal panel 1325 via the common voltage lines 1317, 1322, respectively. On the drain board 1316, the connection point of the common voltage lines extending from the respective boards to the liquid crystal panel becomes a connection point of the common voltage line passing through the package 1318 of the drain driver LSI 1319 on the most left side and the common voltage line passing through the package 1318 of the drain driver LSI 1319 on the most right side. Also, on the gate board 1320, the connection points become connection points of the common voltage lines passing through the packages 1323 of the respective gate driver LSIs 1324. Incidentally, in the common-voltage-line feeding points on this gate board 1320, the common voltage line passing through the packages 1323 of the gate driver LSIs 1324 positioned at the top and in the center is utilized as a route for feedbacking the common voltage to be fed to the liquid crystal panel to the power-supply circuit 1304 on the interface board 1301.

This allows the common voltage inside the liquid crystal panel 1325 to be fedback to the common voltage generating circuit illustrated in FIG. 2, thereby making it possible to feed the common voltage to the liquid crystal panel.

From the above-described explanation, according to the embodiment in the present invention illustrated in FIG. 1, at a point-in-time when a writing-in operation into the first 1 line that has entered the transverse smear occurring regions illustrated in FIG. 5 is terminated, the inside-panel common voltage 902 converges onto the desired common voltage level. Consequently, there occurs none of such phenomena as occurring in the conventional art, such that the effective voltage applied to the liquid crystal is decreased, thereby allowing a high picture-quality display to be implemented. Additionally, the higher potential level and the lower potential level of the overshot voltage of the panel-inputted common voltage 901 are limited and governed by the power-supply voltage of the amplifying circuit 801 and the current amplifying circuit 802. Accordingly, by changing this power-supply voltage level, it becomes possible to change a time-period during which the overshot voltage of the panel-inputted common voltage 901 has been applied.

Also, according to the embodiment illustrated in FIG. 1, the influences of the load by a capacitance or a resistance inside the liquid crystal panel 106 automatically change the overshot-voltage quantity. This results in an effect of absorbing a variation in the load constant of the liquid crystal panel 106, a load variation due to the displayed contents, or the like, thereby allowing an even higher picture-quality display to be implemented.

In the gate-off voltage generating circuit illustrated in FIG. 2, the calculating circuit 312 inputs the reference common voltage transmitted by the voltage line 304 and the adjusted voltage generated by the variable resistor 306, thereby adjusting the potential level of the gate-off voltage. Then, the amplifying circuit 313 and the current amplifying circuit 314 generate the gate-off voltage whose driving capability has been enhanced, then transmitting the generated gate-off voltage to the gate driver circuit 104 via the voltage line 803. As a consequence, it becomes possible to relax a charge/discharge current toward a capacitor formed between the common electrode 116 and the gate-line group 115.

Next, referring to FIGS. 6 to 8, the explanation will be given below regarding a modified embodiment in the present invention.

Figure 6:
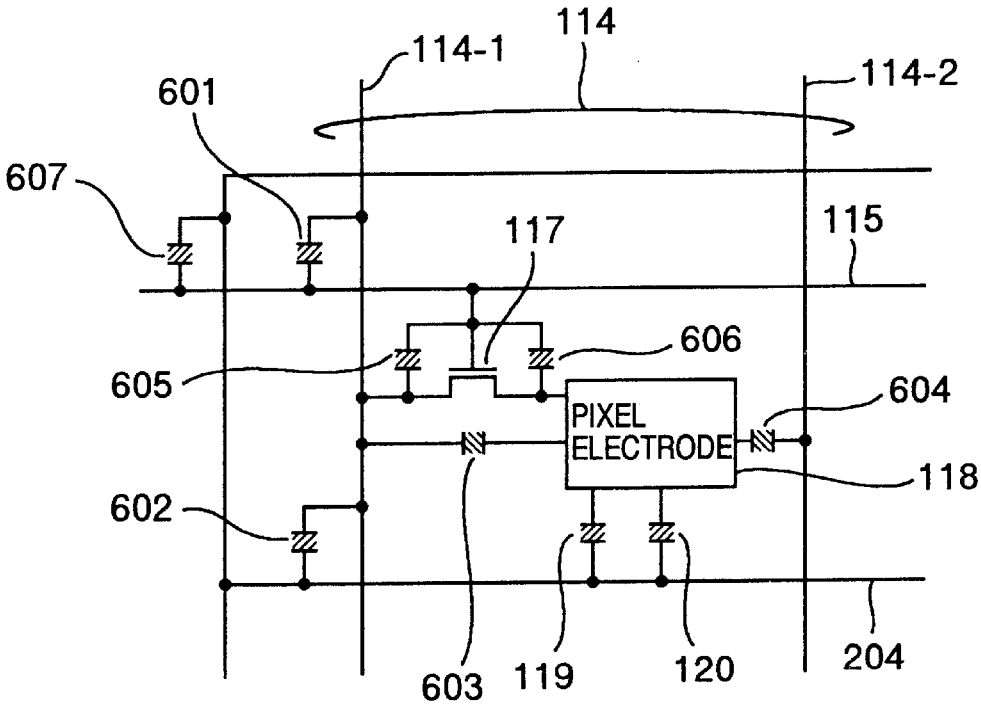
FIG. 6 is a detailed explanatory diagram for explaining an equivalent circuit to a pixel unit in the present invention.

FIG. 6 is a detailed explanatory diagram for explaining an equivalent circuit to a pixel unit in the present invention. FIG. 7 is a diagram for illustrating a modified embodiment of a circuit for generating the gate-off voltage out of the power-supply circuit in the present invention. FIGS. 8A, 8B are diagrams for illustrating voltage waveforms of the common voltage and the gate-off voltage in the present invention.

In FIG. 6, the reference numerals denote the following components: 601 cross capacitance (Cgd1) formed at an intersection portion of the drain-line group 114 and the gate-line group 115, 602 cross capacitance (Cdc) formed at an intersection portion of the drain-line group 114 and the common electrode line 204, 603 parasitic capacitance (Cds1) formed between the pixel electrode 118 and a drain line 114-1, 604 parasitic capacitance (Cds2) formed between the pixel electrode 118 and an adjacent drain line 114-2, 605 parasitic capacitance (Cgd2) formed when the drain line 114-1 and a gate line 115-1 overlap in the TFT 117, 606 parasitic capacitance (Cgs) formed when the gate line 115-1 and the pixel electrode 118 overlap in the TFT 117, 607 cross capacitance (Cgc) formed when the gate line 115-1 and the common electrode line 204 intersects.

Figure 7:
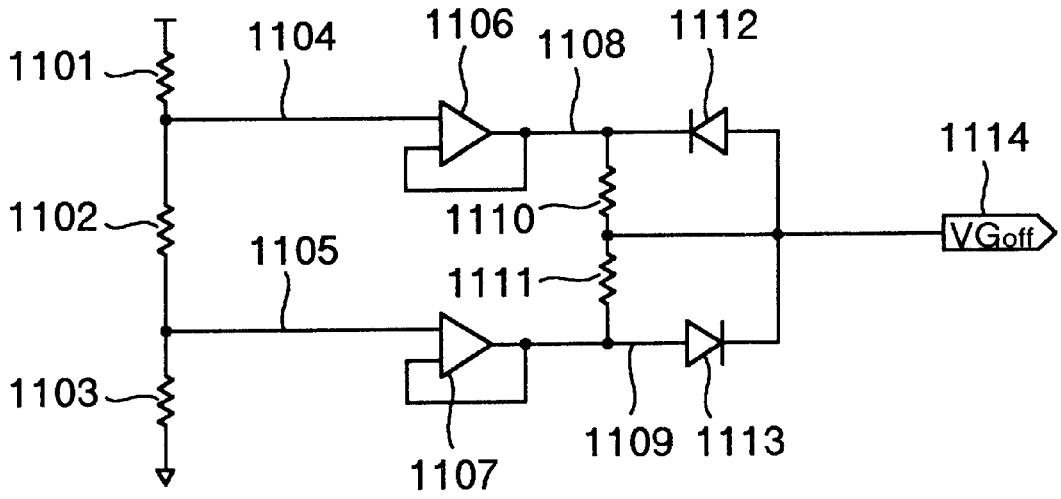
FIG. 7 is a diagram for illustrating a modified embodiment of a circuit for generating the gate-off voltage out of the power-supply circuit in the present invention.
Figure 8A:
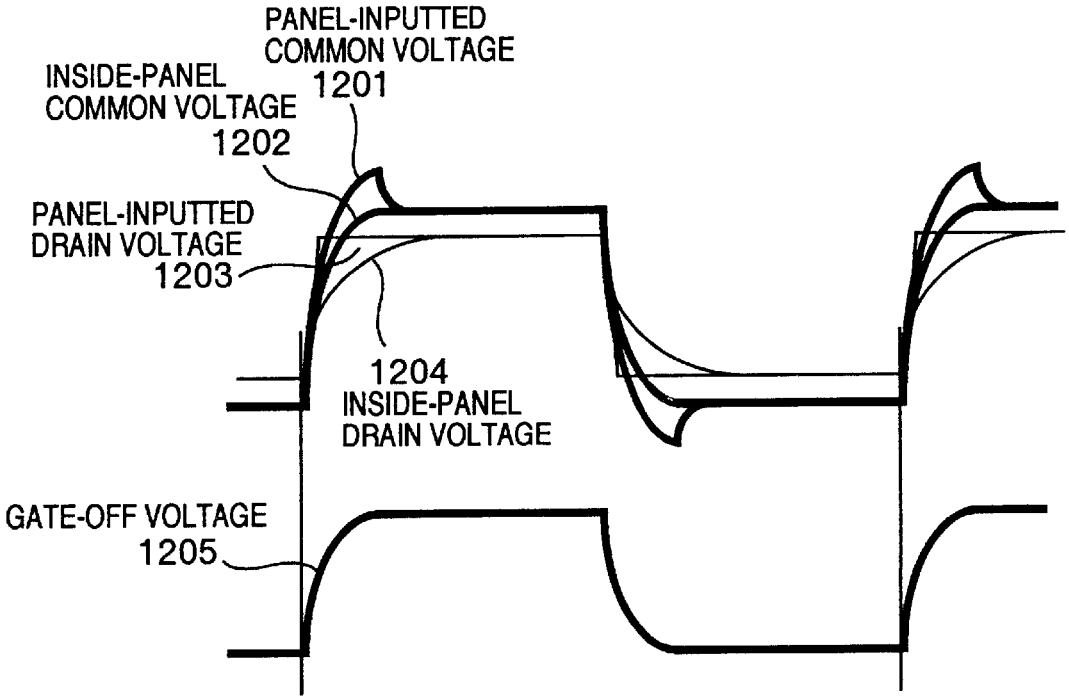
FIGS. 8A, 8B are diagrams for illustrating voltage waveforms of the common voltage and the gate-off voltage in the present invention.
Figure 8B:
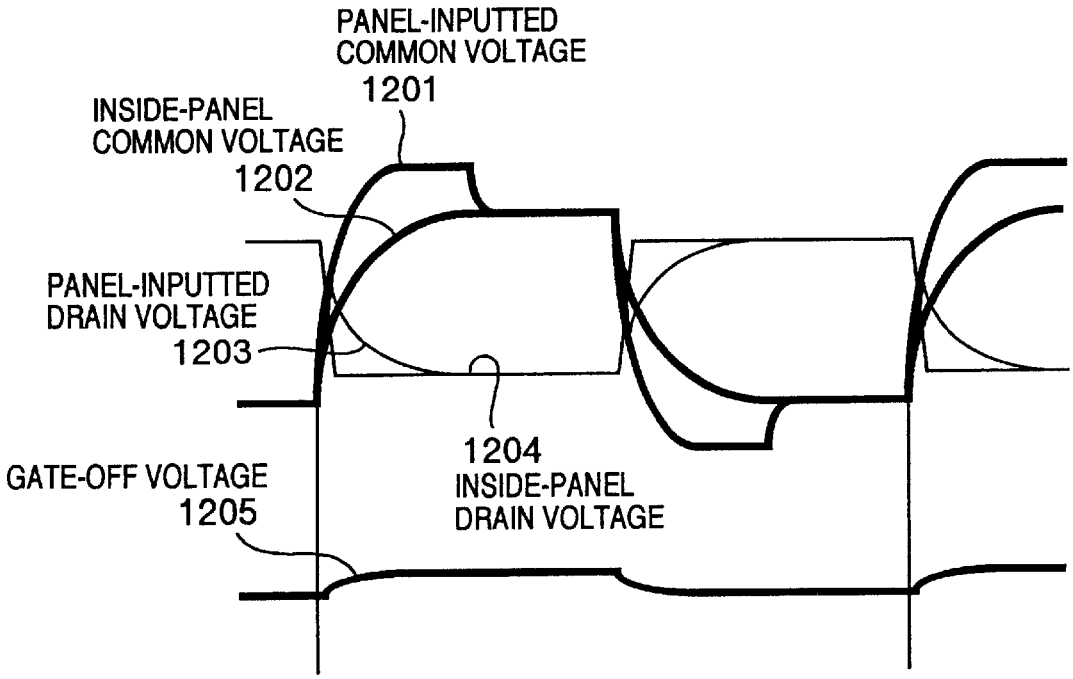

In the modified embodiment in the present invention illustrated in FIGS. 6 to 8, the gate-off voltage generating circuit inside the power-supply circuit 105 in the embodiment illustrated in FIG. 1 differs from the gate-off voltage generating circuit illustrated in FIG. 2.

FIG. 7 illustrates the modified embodiment of this gate-off voltage generating circuit. In FIG. 7, the reference numerals denote the following components: 1101, 1102, 1103 dividing resistors for outputting to power-supply lines 1104, 1105 the gate-off voltage becoming a reference voltage, 1106, 1107 current amplifying circuits for amplifying the gate-off voltage transmitted by the power-supply lines 1104, 1105 and for outputting the gate-off voltage to power-supply lines 1108, 1109 respectively, 1110, 1111 dividing resistors, 1112, 1113 diodes. The gate-off voltage generating circuit illustrated in FIG. 7 receives no voltage-feeding from the common voltage generating circuit.

FIG. 8A illustrates a voltage waveform at the time when the black display (the effective voltage: small) is performed. The reference numerals denote the following voltages: 1201 a panel-inputted common voltage transmitted by the common voltage line 112, 1202 an inside-panel common voltage on the common voltage line 116 inside the liquid crystal panel 106, 1203 a panel-inputted drain voltage at the near end of the drain driver circuit 103 out of the drain voltage that the drain driver circuit 103 outputs, 1204 an inside-panel drain voltage inside the liquid crystal panel 106, 1205 the gate-off voltage. Also, FIG. 8B illustrates a voltage waveform at the time when the white display (the voltage effective-value: large) is performed, and illustrates the voltage waveform at the same locations as those in FIG. 8A.

Cross capacitance and parasitic capacitance as illustrated in FIG. 6 are formed between the respective electrodes in the pixel unit 121 of the liquid crystal display device. Here, the cross capacitance (Cgdl) 601, which is formed at the intersection portion of the drain-line group 114 and the gate-line group 115, and the parasitic capacitance (Cgd2) 605, which is formed when the drain line 114-1 and the gate line 115-1 in the TFT 117 overlap, become a factor of causing the picture-quality degradation to occur. Namely, the alternation of the gate-off voltage in the same phase as that of the common voltage causes the flowing in-and-out of current to occur in the cross capacitance 601 and the parasitic capacitance 605, depending on the voltage waveform state of the drain voltage, i.e., the displayed contents.

The dividing resistors 1101, 1102, 1103 generate a higher potential level voltage of the gate-off voltage and a lower potential level voltage thereof. Then, the respective gate-off level voltages are current-amplified by the current amplifying circuits 1106, 1107, respectively. Next, these current-amplified two types of gate-off voltages are voltage-divided by the high-resistance voltage-dividing resistors 1110, 1111, thereby generating the gate-off voltage to be fed to the liquid crystal panel 106 and then transmitting the gate-off voltage via a power-supply line 1114. Incidentally, the power-supply line 1114 is assumed to be included in the power-supply line 111 illustrated in FIG. 1. Here, the dividing resistors 1110, 1111 have been formed into the high-resistance resistors in order that the gate-off voltage transmitted via the power-supply line 1114 is brought into a high-impedance state. Also, the diodes 1112, 1113 have been provided so that the gate-off voltage will not transition to a potential that is higher or lower than the potential levels of the gate-off voltages generated by the current amplifying circuits 1106, 1107. On account of this, when the gate-off voltage is applied inside the liquid crystal panel 106, it becomes possible to control the gate-off voltage so that the amplitude thereof will not exceed the above-described reference voltage range.

Next, the explanation will be given below concerning its operation.

Referring to FIG. 7, explanation will be given below regarding the gate-off voltage that is the characteristic of the present invention. As described earlier, the gate-off voltage to be fed to the liquid crystal panel 106 has been converted into the driving voltage existing in the high-impedance state. Consequently, on one hand, from the influence of the cross capacitance 601 of the drain line 114-1 illustrated in FIG. 1 and the gate line 115 and the parasitic capacitance 605 in the TFT 117, the gate-off voltage operates in such a manner as to follow the drain voltage. On the other hand, from the influence of the cross capacitance 607 of the gate line 115 illustrated in FIG. 1 and the common electrode 204 (corresponding to the common electrode 116 illustrated in FIG. 1), the gate-off voltage follows the common voltage.

As a consequence, as illustrated in FIG. 8A, in the case where the phase of the drain voltage becomes the same as that of the common voltage, the gate-off voltage has an amplitude whose phase also becomes the same as that of the common voltage and the drain voltage from the influence of the parasitic capacitance and the cross capacitance. Also, as illustrated in FIG. 8B, in the case where the phase of the drain voltage becomes inverted to that of the common voltage, the gate-off voltage is converted into a potential state maintained at a substantially fixed level corresponding to a voltage transition state of the drain voltage and that of the common voltage.

Namely, the gate-off voltage at the high-impedance state driving voltage eventually decreases the capacitance of the load capacitance between the drain line 114-1 and the gate line 115, i.e., the cross capacitor 601. On account of this, in addition to the effect by the common voltage generating circuit illustrated in FIG. 2, it becomes possible to improve the convergency of the drain voltage. Accordingly, there occurs none of such phenomena as described in the embodiments of the prior art, such that the effective voltage applied to the liquid crystal is decreased. This permits the high picture-quality display to be implemented.

Further, according to the modified embodiment of the gate-off voltage generating circuit illustrated in FIG. 7, the gate-off voltage is brought into the high-impedance state. This makes it possible to reduce the charge/discharge electric current toward the cross capacitor between the drain line and the gate line, thereby also resulting in an effect of decreasing the power consumption.

Still further, according to the modified embodiment illustrated in FIGS. 6 to 8, it is possible to lessen, in particular, a phase difference between the drain voltage at the near end of the drain driver circuit and the drain voltage at the far end of the drain driver circuit. This also results in an effect of suppressing a longitudinal luminance inclination occurring in the longitudinal direction of the liquid crystal panel.

Figure 9:
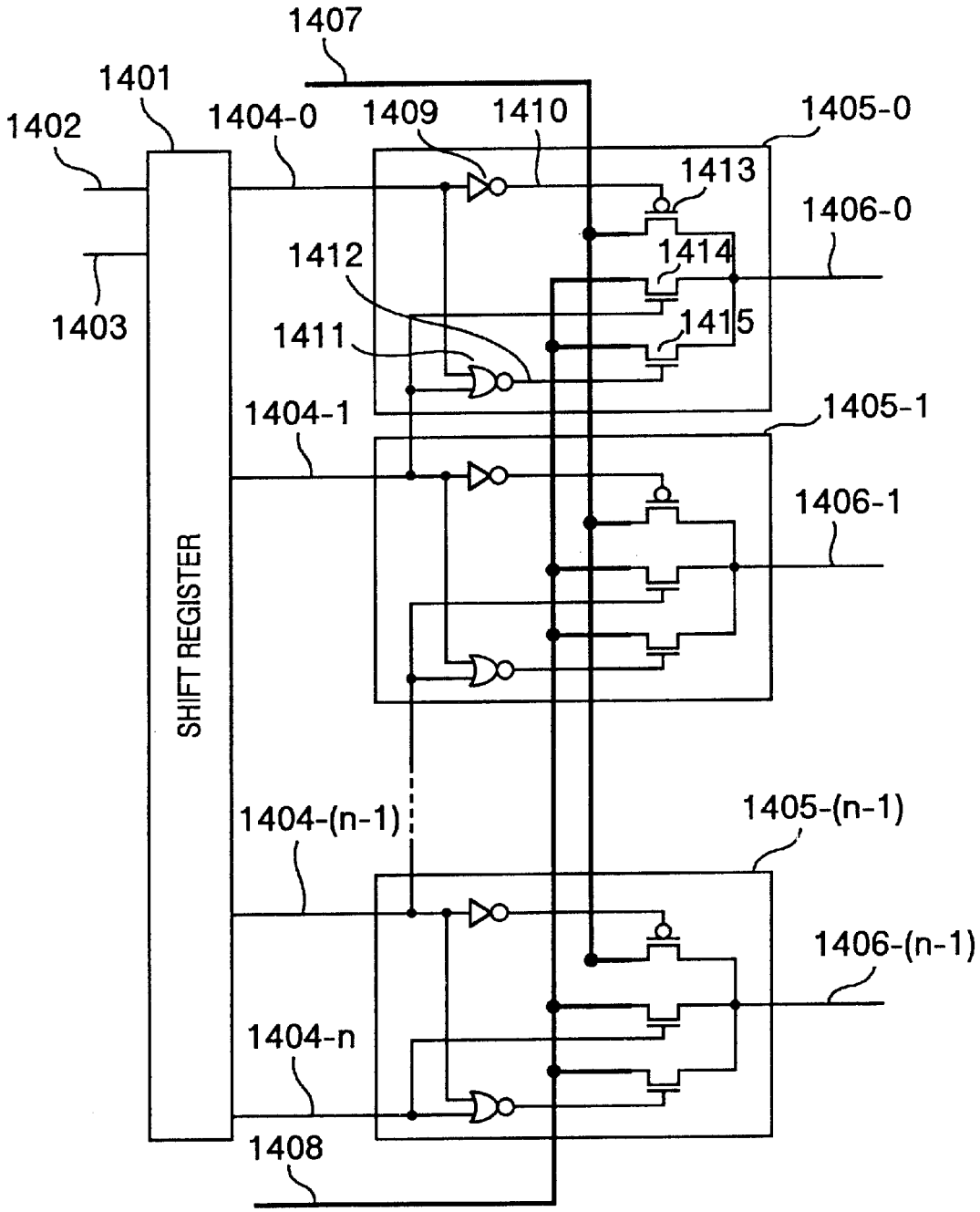
FIG. 9 is a block diagram for illustrating a gate driver in the present invention.

FIG. 9 illustrates the implemented state of the gate driver circuit where the modified embodiment of the gate-off voltage generating circuit illustrated in FIG. 7 has been employed. In FIG. 9, the high-impedance driving of the gate-off voltage according to the present invention has been implemented using the gate driver LSI.

In FIG. 9, the reference numerals denote the following components: 1401 a shift register, 1402 a start signal, 1403 a shift clock, 1404 output signals from the shift register 1401, 1405 a gate voltage selecting circuit, 1406 an output signal from the present gate driver LSI, 1407 a power-supply line for feeding the gate-on voltage, 1408 a power-supply line for feeding the gate-off voltage, 1409 an inversion circuit, 1410 an output signal from the inversion circuit 1409, 1411 a NOR circuit, 1412 an output signal from the NOR circuit 1411, 1413 a P-MOS for the gate-on voltage, 1414 an N-MOS for the gate-off voltage, 1415 an N-MOS for the gate-off voltage.

Figure 10:
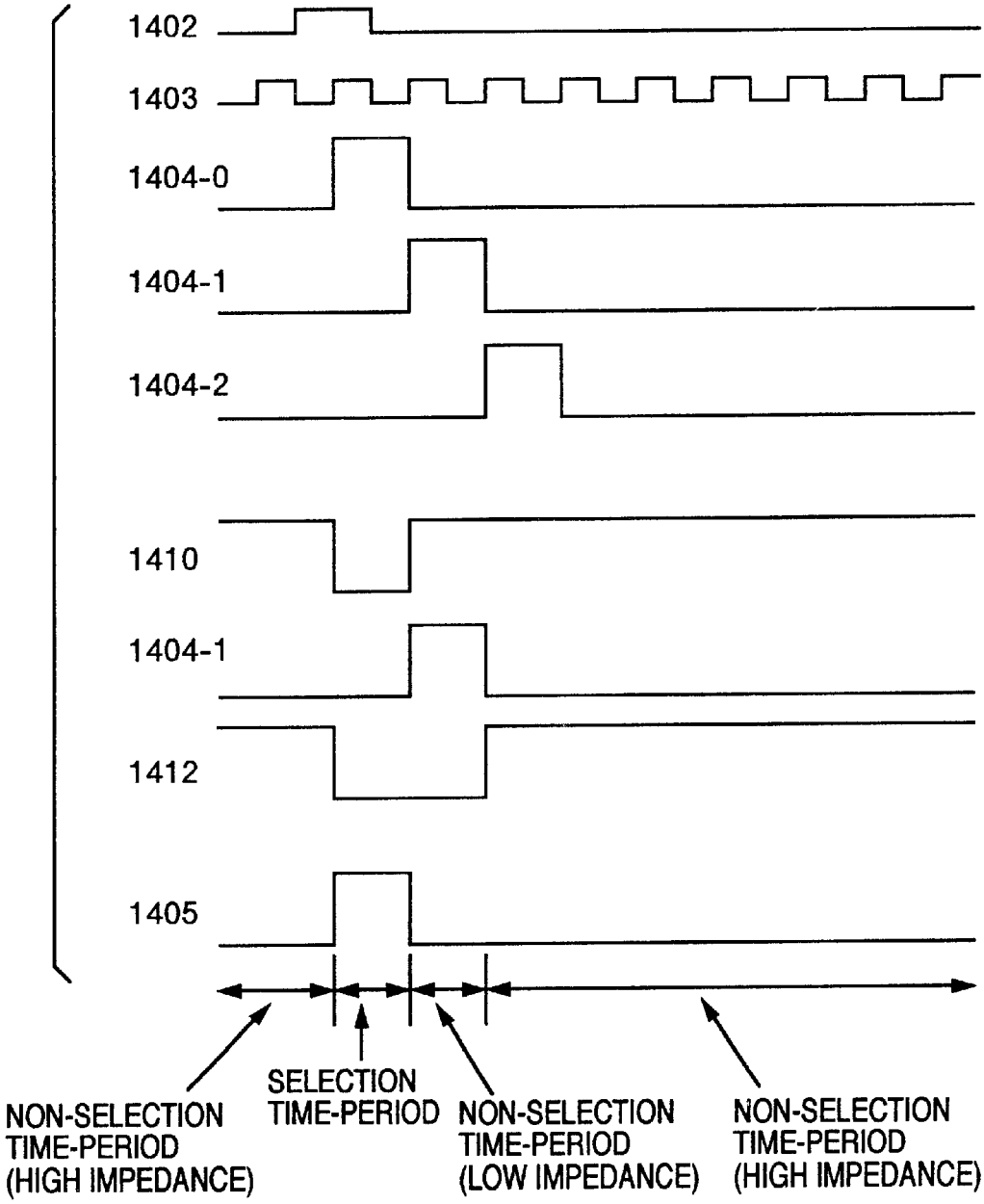
FIG. 10 is a timing chart diagram for explaining the operation of the gate driver in the present invention.

FIG. 10 is a timing chart diagram for explaining the operation of the gate driver LSI illustrated in FIG. 9. FIG. 10 illustrates the operation of the locations corresponding to the respective reference numerals.

Moreover, the MOS gate width of the N-MOS 1414 for gate-off is wide for the low-impedance state. The MOS gate width of the N-MOS 1415 for the gate-off is narrow for the high-impedance state.

As illustrated in FIG. 10, the shift register 1401 outputs in sequence the output signals 1404 in accordance with the start signal 1402 and the shift clock 1403. The P-MOS 1413 in the gate voltage selecting circuit 1405 operates by receiving the output signal 1410 from the inversion circuit 1409. As illustrated in FIG. 10, when the output signal 1410 is at its "Low" level, the gate-on voltage is reflected onto an output signal 1405. The N-MOS 1414 in the gate voltage selecting circuit 1405 operates by receiving the next-line operation signal such as the output signal 1404-1 from the shift register 1401. As illustrated in FIG. 10, when the output signal 1404-1 is at its "High" level, the gate-off voltage is reflected onto the output signal 1405. At this time, this gate-off voltage is changed to the low-impedance state. This is because the voltage applied to the gate line on the liquid crystal panel needs to be caused to transition from the ON voltage to the OFF voltage at a high-speed. The N-MOS 1415 in the gate voltage selecting circuit 1405 operates by receiving the output signal 1412 from the NOR circuit 1411. As illustrated in FIG. 10, when the output signal 1412 is at its "High" level, the gate-off voltage is reflected onto the output signal 1405. At this time, this gate-off voltage is changed to the high-impedance state.

The above-explained configuration of the gate driver LSI also allows the gate-off voltage to be changed to the high-impedance state.

As having been explained so far, according to the embodiment illustrated in FIGS. 1 to 4 in the present invention, the common voltage inside the liquid crystal panel is fedback to the common voltage generating circuit out of the power-supply circuit. Consequently, the common voltage to be outputted to the liquid crystal panel has a voltage waveform that is overshot onto a positive-polarity side when, with the timing of the alternation, the common voltage transitions from the negative-polarity to the positive-polarity and that is overshot onto a negative-polarity side when the common voltage transitions from the positive-polarity to the negative-polarity. As a result, the common voltage inside the liquid crystal panel transitions to a higher potential (or a lower potential). This results in an effect of allowing the convergency to be improved, and brings about an effect of making it possible to prevent the picture-quality degradation referred to as the transverse smear and to implement the high picture-quality display.

Moreover, according to the embodiment illustrated in FIGS. 1 to 4 in the present invention, the common voltage inside the liquid crystal panel is fedback to the common voltage generating circuit. Accordingly, it becomes possible to feed, to the liquid crystal panel, the common voltage in response to a variation in the load constant of the liquid crystal panel and a common voltage distortion due to the displayed contents. This results in an effect of making it possible to improve the convergency of the common voltage inside the liquid crystal panel and to implement the high picture-quality display.

Also, according to the modified embodiment illustrated in FIGS. 6 to 10 in the present invention, the gate-off voltage is brought into the high-impedance state. As a result, it becomes possible to reduce the charge/discharge electric current toward the cross capacitance between the drain line and the gate line. This results in an effect of making it possible to improve the convergency of the drain voltage inside the liquid crystal pane, and brings about an effect of making it possible to prevent the picture-quality degradation referred to as the transverse smear and to implement the high picture-quality display.

Further, according to the modified embodiment in the present invention, the gate-off voltage is brought into the high-impedance state. As a result, it becomes possible to reduce the charge/discharge electric current toward the cross capacitor between the drain line and the gate line. This also results in an effect of decreasing the power consumption.

Still further, according to the modified embodiment in the present invention, it is possible to lessen, in particular, a phase difference between the drain voltage at the near end of the drain driver circuit and the drain voltage at the far end of the drain driver circuit. This also results in an effect of suppressing a longitudinal luminance inclination occurring in the longitudinal direction of the liquid crystal panel.

What is claimed is:

1. A display device, comprising:

a display panel for displaying a tone in correspondence with a potential difference between a drain voltage and a common voltage which are applied to a plurality of switching elements, a drain driver circuit for generating said drain voltage corresponding to said display data and applying said drain voltage to said display panel, a gate driver circuit for selecting a scanning line in said display panel to which said drain voltage is applied, and a power-supply circuit for executing a comparative calculation of a reference common voltage and a feedback common voltage so as to apply said common voltage to said display panel, said reference common voltage having an adjustable potential level, said feedback common voltage being fedback from said display panel, and said common voltage being obtained as a result of said comparative calculation, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display.

2. The display device as claimed in claim 1, wherein, when said reference common voltage transitions to a higher potential, said common voltage applied to said display panel transitions to an even higher potential than said reference common voltage.

3. The display device as claimed in claim 1, wherein, when said reference common voltage transitions to a lower potential, said common voltage applied to said display panel transitions to an even lower potential than said reference common voltage.

4. The display device as claimed in claim 1, wherein said power-supply circuit alternates a gate-off voltage in the same phase as that of said reference common voltage, and applies said gate-off voltage to said gate driver circuit, said gate-off voltage being used for switching off gates of said switching elements in said display panel.

5. The display device as claimed in claim 1, wherein said power-supply circuit converts a gate-off voltage into a high-impedance state, and applies said gate-off voltage to said gate driver circuit, said gate-off voltage being used for switching off gates of said switching elements in said display panel.

6. The display device as claimed in claim 1, wherein said power-supply circuit generates a gate-off voltage, and applies said gate-off voltage to said gate driver circuit, said gate-off voltage being used for switching off gates of said switching elements in said display panel, an amplitude quantity of said gate-off voltage in a case where said potential difference between said drain voltage and said common voltage is small is larger in comparison with an amplitude quantity of said gate-off voltage than a potential difference is between said drain voltage and said common voltage in a case where said potential difference between said drain voltage and said common voltage is large.

7. The display device as claimed in claim 1, wherein said power-supply circuit comprises a calculating circuit for adjusting said potential level of said reference common voltage, an amplifying circuit for executing said comparative calculation of said reference common voltage and said feedback common voltage, and current amplifying circuit for amplifying current of said comparatively-calculated common voltage.

8. The display device as claimed in claim 1, wherein said feedback common voltage is fedback to said power-supply circuit from at least one of an upper-portion side and a central-portion side of said display panel.

9. The display device as claimed in claim 1, wherein said power-supply circuit alternates said reference common voltage on each said scanning line basis.

10. The display device as claimed in claim 1, wherein an amplitude of said gate-off voltage at the section of pixels of said display panel in a case where said drain voltage is in phase with said common voltage is larger than the amplitude of said gate-off voltage at said section of pixels in a case where said drain voltage is in opposite phase to said common voltage.

11. The display device as claimed in claim 1, wherein said intermediate potential of said gate-off voltage is a substantially fixed potential level.

12. A display device, comprising:

a display panel, a drain driver circuit for generating a drain voltage corresponding to display data and applying said drain voltage to said display panel, a gate driver circuit for selecting a scanning line in said display panel to which said drain voltage is applied, and a power-supply circuit for generating a common voltage in response to at least one of a load constant of said display panel and a common voltage distortion caused by said display data, and applying said common voltage to said display panel, said common voltage becoming a reference of said drain voltage, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display panel.

13. The display device as claimed in claim 12, wherein said intermediate potential of said gate-off voltage is a substantially fixed potential level.

14. A method of driving a display device, comprising the steps of:

inputting, into a display panel, a drain voltage corresponding to display data, inputting a common voltage from a power-supply circuit into said display panel, said common voltage becoming a reference of said drain voltage, and feedbacking, to said power-supply circuit, said common voltage outputted from said display panel, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display panel.

15. The method of driving a display device as claimed in claim 14, wherein said intermediate potential of said gate-off voltage is a substantially fixed potential level.

16. A display device, comprising:

a display panel, a drain driver circuit for generating a drain voltage corresponding to display data and applying said drain voltage to said display panel, a gate driver circuit for selecting a scanning line in said display panel to which said drain voltage is applied, and a power-supply circuit for converting a gate-off voltage into a high-impedance state and applying said gate-off voltage to said gate driver circuit, said gate-off voltage being used for switching off gates of switching elements in said display panel, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display panel.

17. The display device as claimed in claim 16, wherein an amplitude of said gate-off voltage at the section of pixels of said display panel in a case where said drain voltage is in phase with said common voltage is larger than the amplitude of said gate-off voltage at said section of pixels in a case where said drain voltage is in opposite phase to said common voltage.

18. The display device as claimed in claim 16, wherein said intermediate potential of said gate-off voltage is a substantially fixed potential level.

19. A display device, comprising:

a display panel, a drain driver circuit for generating a drain voltage corresponding to display data and applying said drain voltage to said display panel, a gate driver circuit for selecting a scanning line in said display panel to which said drain voltage is applied, and a power-supply circuit for voltage-dividing a gate-off voltage at a higher potential and a gate-off voltage at a lower potential, and applying voltage-divided gate-off voltages to said gate driver circuit, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display panel.

20. The display device as claimed in claim 19, wherein said intermediate potential of said gate-off voltage is a substantially fixed potential level.

21. A display device comprising:

a display panel for displaying a tone in correspondence with a potential difference between a drain voltage and a common voltage which are applied to a plurality of switching elements, a drain driver circuit for generating said drain voltage corresponding to said display data and applying said drain voltage to said display panel, a gate driver circuit for selecting a scanning line in said display panel to which said drain voltage is applied, and means for suppressing transverse smear in said display device, including means for improving convergence of at least one of said common voltage and said drain voltage inside said display panel, including a power-supply circuit for executing a comparative calculation of a reference common voltage and a feedback common voltage so as to apply said common voltage to said display panel, said reference common voltage having an adjustable potential level, said feedback common voltage being fedback from said display panel, and said common voltage being obtained as a result of said comparative calculation, wherein, if said drain voltage is in phase with said common voltage, a gate-off voltage applied at a section of pixels of said display panel is in phase with said drain voltage and said common voltage at the section of pixels of said display panel, and, if said drain voltage is in opposite phase to said common voltage, said gate-off voltage applied at the section of pixels of said display panel has an intermediate potential between said drain voltage and said common voltage at the section of pixels of said display panel.

* * * * *